US005503218A

United States Patent [19]

Campion et al.

[11] Patent Number: 5,503,218

[45] Date of Patent: Apr. 2, 1996

[54] METHOD OF MAKING A SHELL MOULD FROM A CERAMIC MATERIAL FOR A DISPOSABLE PATTERN CASTING PROCESS

[75] Inventors: Isabelle M. M. Campion, Eaubonne; Christian Marty, Boulogne, both of France

[73] Assignee: Societe Nationale D'Etude et de Moteurs D'Aviation "Snecma", Paris, France

[21] Appl. No.: 371,867

[22] Filed: Jan. 12, 1995

[30] Foreign Application Priority Data

Jan. 12, 1994 [FR] France ..... 94 00242

[51] Int. Cl.[6] ..... B22C 9/24

[52] U.S. Cl. ..... 164/516; 164/34; 164/35

[58] Field of Search ..... 164/45, 516, 34, 164/35, 517, 518, 519

[56] References Cited

U.S. PATENT DOCUMENTS

| | | | |
|---|---|---|---|
| 4,384,607 | 5/1983 | Wood et al. | 164/34 |
| 4,640,728 | 2/1987 | Martin et al. | 164/45 |
| 4,657,063 | 4/1987 | Morris | 164/45 |

FOREIGN PATENT DOCUMENTS

| | | |
|---|---|---|
| 440296 | 12/1935 | Sweden . |
| WO85/05583 | 12/1985 | WIPO . |

OTHER PUBLICATIONS

JP55064946 Making Method Of Mold, Chiba Nobuyuki, May 16, 1980, vol. 4, No. 105, (M–023).

JP5228611, Method For Inspecting Remained Core In Precision Casting, Miyazaki Tomoaki, Sep. 7, 1993, vol. 17, No. 675, (M–1526).

Investment Casting For The Future, R. F. Smart, Foundry Trade Journal 161, 1987, 12 Mar., Mo. 3344, Redhill, Surrey, Great Britian, pp. 184, 187, 189, 190.

Full–Mold Casting Goes Mass Production, Donald R. Dreger, Machine Design vol. 54, 1982, Nov. No. 27, Cleveland, Ohio, pp. 47–51.

Precision Casting Supplement, Richard Southgate, Foundry Trade Journal, vol. 154, 1983, Mar., No. 3258, Brighton, Great Britain, pp. 315–318, 321, 322.

*Primary Examiner*—Kurt Rowan
*Assistant Examiner*—Randolph S. Herrick
*Attorney, Agent, or Firm*—Oblon, Spivak, McClelland, Maier & Neustadt

[57] ABSTRACT

A method of making a ceramic shell mould for casting includes making a pattern having an internal cavity in two parts from a disposable material, glueing the two parts together to complete the hollow pattern, filling the internal cavity with a ceramic material, and simultaneously or subsequently forming a shell of a ceramic material around the filled pattern. The pattern can then be eliminated to obtain a casting mould with an inner core made in situ.

11 Claims, 1 Drawing Sheet

METHOD OF MAKING A SHELL MOULD FROM A CERAMIC MATERIAL FOR A DISPOSABLE PATTERN CASTING PROCESS

BACKGROUND OF THE INVENTION

1. Field of the Invention

The present invention relates to a method of making a shell mould from a ceramic material for use in the manufacture of components by a casting process called disposable pattern casting.

2. Summary of the Prior Art

In precision casting, particularly in the aeronautical field such as in the manufacture of vanes or blades for turbojet engines where components have to conform to strict quality criteria, it is well known to use disposable pattern type processes. These are still called "lost wax" processes when the patterns are made of wax, but it is now common also to use resin type materials. When casting hollow components, as is the case for internally cooled hollow vanes, the standard lost wax casting process requires the use of cores of ceramic material, which are held in the mould when the metal is cast. The outer surface of the core forms the inner surface of an internal cavity in the finished product so cast.

Various techniques have been devised and used for the manufacture of these ceramic cores, which take the form of individual elements, and starting from the core the casting process continues with the following steps:

injection of the wax pattern around the core;

making the shell mould from a ceramic material around the pattern;

elimination of the wax pattern;

finishing the mould;

preheating and casting the alloy;

cooling the alloy;

elimination of the core and mould.

In spite of the progress achieved, the preparation of the cores, with the stresses associated with the above-mentioned applications, remains a difficult process to carry out. In addition to the need to use specialized tooling and the length of time involved, leading to high manufacturing costs, the accurate finishing is often time-consuming and delicate, and manufacturing wastage is relatively high.

It is an object of the invention, therefore, to obviate the numerous drawbacks of the methods which have been used in the past for the preparation and utilization of casting cores made of ceramic material.

SUMMARY OF THE INVENTION

To this end, according to the invention there is provided a method of making a shell mould from a ceramic material for a casting process of the disposable pattern type, including the steps of:

(a) making a pattern having an internal cavity in two parts from a material which can be eliminated by melting, sublimation or thermal degradation;

(b) glueing said two parts together to complete said pattern;

(c) filling said internal cavity of said pattern with a ceramic composition based material; and (d) forming a shell of a ceramic material around said pattern.

Preferably, the filling of the cavity is checked by radiography.

Having regard to the particular applications for which the invention is intended, such as the production of moulds for the casting of hollow vanes for turbomachines, it may be advantageous to assemble a plurality of patterns in a cluster and to form the shells around the patterns simultaneously. In this case the cluster may be formed by the assembly of filled patterns, and the shells made either by successively dipping the cluster in a ceramic slip and drying the coated cluster before repeating the dipping, or by immersing the cluster in a fast-setting slip. Alternatively, the cluster may be formed by the assembly of the completed hollow patterns, and said filling step (c) and said shell forming step (d) are carried out simultaneously by immersion of said cluster in a fast chemically setting ceramic slip.

Other preferred features and advantages of the invention will become apparent from the following description of the preferred embodiments, given by way of example, with reference to the attached drawings.

DESCRIPTION OF THE PREFERRED EMBODIMENTS

Figure 1:
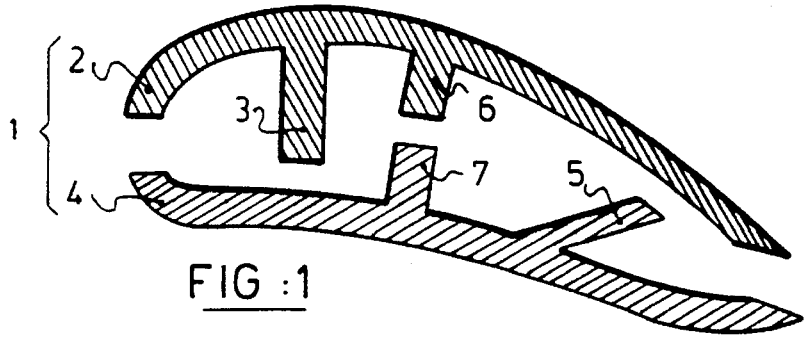
FIG. 1 is a diagrammatic transverse sectional view of a two-part pattern for one example of a component to be made by disposable pattern casting, the pattern being used in making a mould of ceramic material by the method of the invention.
Figure 2:
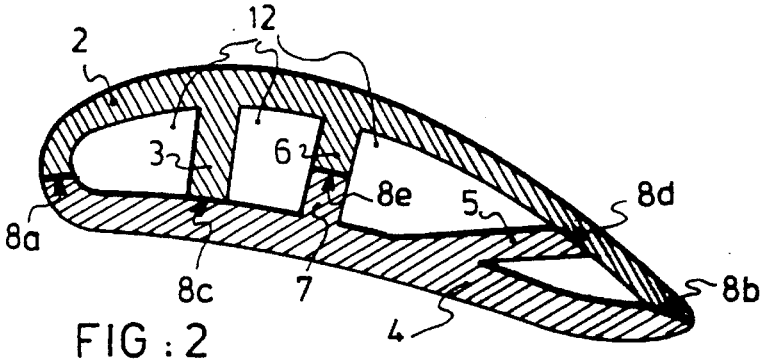
FIG. 2 is a view similar to that of FIG. 1, but showing the pattern in an assembled state.

FIG. 1 shows a two-part pattern 1 which, when assembled (as shown in FIG. 2), is a replica of a component which is to be cast. The pattern 1 is made of wax or a resin type material, or any material which is known per se for this purpose, and such that the pattern can be eliminated when required by melting, sublimation or thermal degradation.

In the example shown the pattern 1 corresponds to a hollow vane for a turbomachine, in particular a cooled vane for an aircraft engine, and is formed in two parts, namely an extrados or outwardly curved face part 2 carrying on its inner side a transverse partition 3, and an intrados or inwardly curved face part 4 carrying on its inner side a slanting partition 5, each part carrying in addition a partition half 6, 7 respectively. The geometry of the pattern, and the number and position of the partitions are determined for each particular application depending on the number and the shape of the vane cavities to be obtained. As indicated, the partitions are integrated with one part or the other of the pattern, or may be made as halves on the two parts.

FIG. 1 shows the result of the first stage (a) of the method in accordance with the invention, in which the two parts of the pattern are made. The second stage (b) of the method consists of assembling the pattern by glueing the two parts together. FIG. 2 shows the results of the assembly of the two parts 2 and 4, the glued areas being indicated at 8*a*, 8*b*, 8*c*, 8*d* and 8*e* and corresponding respectively to the areas of the leading edge of the vane, the trailing edge, and the connections of the partitions 3, 5 and 6, 7.

The third stage (c) of the method consists of filling the internal cavity of the hollow pattern 1 obtained from the second stage (b) with a ceramic composition based material. To this end, the hollow pattern 1 may be immersed in a slip having a base of a quick chemically setting ceramic material, the composition of which is known per se. A container 9 holding the slip 10 may be placed inside an evacuated enclosure 11, as shown diagrammatically in FIG. 3, and hollow patterns 1 carried by a support 13 are arranged in such a way that the slip 10 enters the open ends of the cavities 12. Filling under vacuum avoids the creation of inclusions resulting from the presence of air bubbles in the structure obtained in the cavity of the pattern 1. A check on the quality of fill obtained may be performed by radiographic verification on each pattern 1.

The next stage (d) of the method consists of making a shell of ceramic material around the filled pattern 1, e.g. by a standard procedure of dipping the pattern in a ceramic slip followed by drying the dipped pattern, and repeating this procedure until the required shell thickness is obtained. Alternatively, the shell may be formed by immersing the pattern in a fast chemically setting ceramic slip of known composition.

In the applications with which the invention is particularly concerned, such as the manufacture of cooled turbomachine vanes, the stage (d) may be preceded by a step in which a plurality of filled patterns 1 are assembled in clusters, in accordance with standard disposable pattern casting techniques.

In an alternative embodiment enabling a saving of time in certain particular applications, the completion of the hollow patterns in stage (b) is followed by the assembly of a plurality of the hollow patterns 1 to form a cluster, and stage (c) and (d) are carried out simultaneously by immersion of the cluster in a fast chemically setting ceramic slip of known composition.

Figure 3:
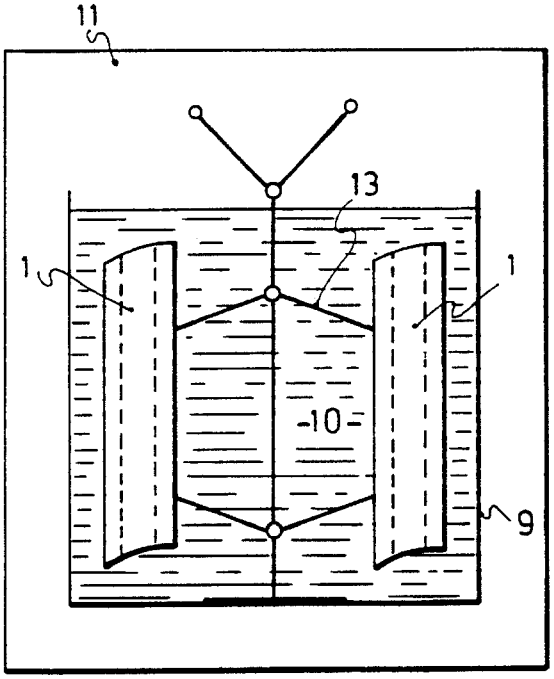
FIG. 3 is a diagrammatic view illustrating a step in one embodiment of the method of the invention; and, FIG. 4 is a diagrammatic part perspective view showing one example of a cluster of patterns in another embodiment of the method of the invention.

As shown in the diagram of FIG. 3, the immersion is preferably carried out in an evacuated enclosure 11 so as to ensure the correct filling of the internal cavities of the patterns. A tomographic examination may then be carried out to check the results.

Figure 4:
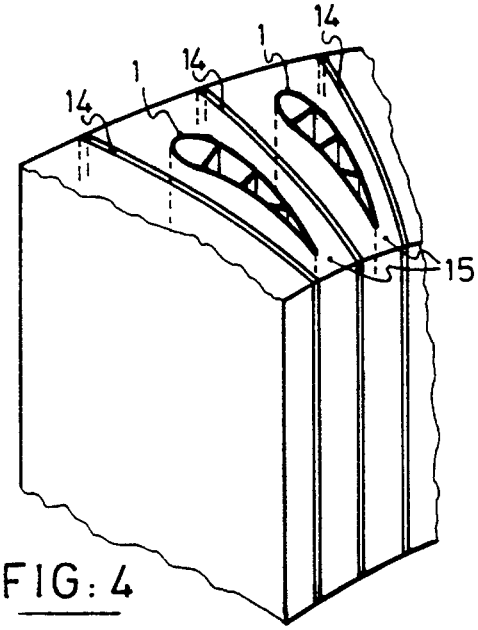

As shown in FIG. 4, the patterns 1 joined together as a cluster have forms 14, made of wax or other material used for the production of the disposable patterns, inserted between them. This arrangement enables gaps to be obtained between the ceramic shells 15 formed around each pattern by the immersion, hence avoiding the formation of an entirely unitary shell. The forms 14 may be integrated with the cluster when the latter is being created.

In an alternative arrangement separation between the shells 15 may be achieved by placing the patterns 1 constituting the cluster in appropriate framework, which can be dismantled or broken up after the extraction of the assembly from the immersion bath.

The operations in accordance with the invention as described above may be followed by the following standard steps in the completion of the shell moulds and their use in casting the required components:

elimination of the disposable pattern;

finishing of the mould;

preheating the mould and casting the metal alloy therein;

cooling of the cast component;

elimination of all the ceramic parts, both inside and outside the component, by a standard method suited to each particular application, such as by breaking the mould, sanding or dissolving and cleaning.

In applications involving oriented or monocrystalline solidification, the gaps between the moulds obtained as described above with reference to FIG. 4 are essential to permit the heat transfers desired during the casting of the metal.

As well as the above advantages, it will be noted that using the same ceramic material for filling the cavity of the pattern and forming the outer shell mould prevents the occurrence of dimensional problems due to expansion gaps and the use of adjusting shims to remedy this.

In addition to the simplification of the method, the saving of time and the cost saving resulting from this, it will be noted that the in situ manufacture of the inner part of the shell mould in the method of the invention, instead of the previous use of cores, avoids the difficulties and other drawbacks attaching to the use of such cores, such as breakage problems at various stages of manufacture and utilization, particularly during the injection of the wax or other material forming the pattern, problems associated with movements and the resulting need for repositioning, and production wastage ratios.

We claim:

1. A method of making a shell mould from a ceramic material for a casting process of the disposable pattern type, including the steps of:

(a) making a pattern having an internal cavity in two parts from a material which can be eliminated;

(b) glueing said two parts together to complete said pattern;

(c) filling said internal cavity of said pattern with a ceramic composition based material; and (d) forming a shell of a ceramic material around said pattern.

2. A method according to claim 1, wherein said material which can be eliminated includes at least one of a wax and a resin.

3. A method of making a shell mould from a ceramic material for a casting process of the disposable pattern type, including the steps of:

(a) making a pattern having an internal cavity in two parts from a material which can be eliminated by melting, sublimation or thermal degradation;

(b) glueing said two parts together to complete said pattern;

(c) filling said internal cavity of said pattern with a ceramic composition based material; and (d) forming a shell of a ceramic material around said pattern.

4. A method according to claim 3, wherein said filling step (c) is carried out under vacuum using a chemically setting ceramic paste, and is followed by the step of verifying radiographically that said internal cavity is completely filled before carrying out said shell forming step (d) around said filled pattern.

5. A method according to claim 4, including the further step of assembling into a cluster a plurality of said filled patterns after said step of radiographically verifying the filling thereof, and said shell forming step (d) comprises successively dipping said cluster into a ceramic slip and drying said dipped cluster until the required shell thickness is obtained.

6. A method according to claim 4, including the further step of assembling into a cluster a plurality of said filled patterns after said step of radiographically verifying the filling thereof, and said shell forming step (d) comprises immersing said cluster in a fast chemically setting ceramic slip.

7. A method according to claim 3, including the further step of assembling into a cluster a plurality of said completed patterns after said glueing step (b), and said filling step (c) and said shell forming step (d) are carried out simultaneously by immersion of said cluster in a fast chemically setting ceramic slip.

8. A method according to claim 7 wherein said immersion is carried out in an evacuated enclosure.

9. A method according to claim 6 or claim 5, wherein said step of assembling said cluster of patterns includes the steps of locating between said patterns forms made of wax or the same material as said patterns, and integrating said forms with said cluster.

10. A method according to claim 6 or claim 7, wherein said step of assembling said cluster of patterns includes the step of providing a framework arrangement of a plurality of said patterns with said patterns separated from one another, and said method further includes the step of removing said framework by dismantling or destroying it after said filling and shell forming steps (c) and (d).

11. A method according to claim 6 or claim 7, including the additional step of tomographically checking the shell mould so produced.

* * * * *